United States Patent [19]

Theurer et al.

[11] Patent Number: 4,632,037

[45] **Date of Patent: * Dec. 30, 1986**

[54] MOBLE TRACK LEVELING, LINING AND TAMPING MACHINE

[75] Inventors: Josef Theurer, Vienna; Johann Hansmann, Klosterneuburg, both of Austria

[73] Assignee: Franz Plasser Bahnbaumaschinen-Industriegesellschaft m.b.H., Vienna, Austria

[ * ] Notice: The portion of the term of this patent subsequent to Aug. 13, 2002 has been disclaimed.

[21] Appl. No.: 610,343

[22] Filed: May 15, 1984

[30] Foreign Application Priority Data

Aug. 19, 1983 [AT] Austria ..... 2970/83

[51] Int. Cl.[4] ..... E01B 27/17

[52] U.S. Cl. ..... 104/7.2; 104/12

[58] Field of Search ..... 104/2, 7 R, 7 B, 12

[56] References Cited

U.S. PATENT DOCUMENTS

| | | | |
|---|---|---|---|
| 3,469,534 | 9/1969 | Plasser et al. | 104/7 B |
| 3,494,297 | 2/1970 | Plasser et al. | 104/7 B |
| 3,744,428 | 7/1973 | Plasser et al. | 104/12 |
| 3,795,198 | 3/1974 | Plasser et al. | 104/12 |
| 3,949,678 | 4/1976 | Theurer | 104/12 |
| 4,165,693 | 8/1979 | Theurer | 104/7 B |
| 4,165,694 | 8/1979 | Theurer | 104/7 B |
| 4,249,468 | 2/1981 | Klaar | 104/12 |
| 4,356,771 | 11/1982 | Theurer | 104/7 B |

FOREIGN PATENT DOCUMENTS

| | | |
|---|---|---|
| 2070670 | 9/1981 | United Kingdom . |
| 1033373 | 8/1983 | U.S.S.R. . |

*Primary Examiner*—Randolph A. Reese

*Attorney, Agent, or Firm*—Kurt Kelman

[57] ABSTRACT

A mobile machine for leveling, lining and tamping a track has a heavy main frame supported on undercarriages for continuous movement in an operating direction, a power plant, a drive for continuously advancing the main frame along the track in the operating direction and a brake for stopping the advance of the main frame, the power plant, the drive and the brake carried by the main frame, and a lighter subframe pivotally and longitudinally adjustably connected to the heavy main frame. Tamping heads are mounted on the subframe for tamping ballast in intermittent tamping cycles under respective the ties at points of intersection of the two rails and the ties. A track lifting and lining unit is associated with the two rails mounted on the subframe ahead of the tamping heads in the operating direction, and the tamping heads and track lifting and lining unit being arranged on the subframe between two undercarriages spaced in the direction of the track, one of said undercarriages wherebetween the tamping and track lifting and lining unit is arranged being a further undercarriage supporting the subframe on the track. There is another drive for stop-and-go advancement of the subframe synchronously with the intermittent tamping cycles, and a stop-and-go advancement drive and/or brake arranged to operate on the further undercarriage.

17 Claims, 4 Drawing Figures

MOBLE TRACK LEVELING, LINING AND TAMPING MACHINE

Figure 1:
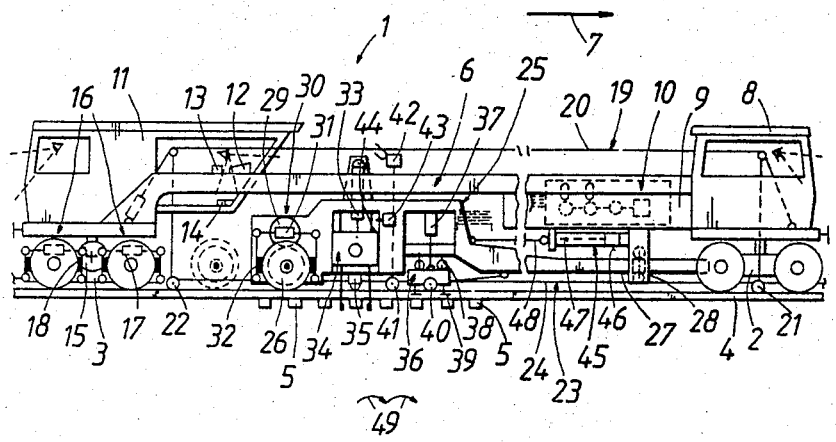

The present invention relates to improvements in a mobile machine for leveling, lining and tamping a track consisting of two rails fastened to successive ties resting on ballast. The machine comprises a heavy main frame supported on undercarriages for continuous movement in an operating direction, a power plant and operating control means including motion-effecting means consisting of drive means for continuously advancing the main frame along the track in the operating direction and brake means for stopping the advance of the main frame, the power plant and the control means being carried by the main frame and at least one of the motion-effecting means being arranged to operate on at least one of the undercarriages, and a lighter subframe means pivotally and longitudinally adjustably connected to the heavy main frame. Tamping means is mounted on the subframe means for tamping ballast in intermittent tamping cycles under respective ones of the ties at points of intersection of the two rails and the respective ties, and track lifting and lining means is associated with the two rails mounted on the subframe means ahead of the tamping means in the operating direction, the track lifting and lining means being arranged on the subframe means between two undercarriages spaced in the direction of the track, at least one of said undercarriages wherebetween the tamping and track lifting and lining means are arranged being a further undercarriage supporting the subframe means on the track. Track leveling and lining reference systems are associated with the track lifting and lining means. The machine has a drive for stop-and-go advancement of the subframe means synchronously with the intermittent tamping cycles.

In the development of continuously moving track leveling, lining and tamping machines, it is desirable to overcome or at least to reduce such phenomena necessarily connected with the stop-and-go advancement of the tamping heads between tamping cycles as the high stresses to which essential structural components of the machine are subjected due to the constant repetition of acceleration and braking as well as the physical stresses on the operating personnel due to the alternatingly accelerating and decelerating forces of the heavy masses moving along the track. Various structures have been proposed to enable mobile tampers to advance continuously along the track while performing intermittent tamping cycles but none of them has been successful in practical track maintenance operations.

U.S. Pat. No. 4,249,468, dated Feb. 10, 1981, discloses a mobile track tamping machine for tamping ballast under successive ties during the continuous advancement of the machine. The machine comprises a tamping tool carrier vertically adjustably mounted on the machine frame between a rear undercarriage and a track lifting and lining unit, the tamping tool carrier being rotatably about a horizontal axis with tamping tools projecting therefrom like spokes for sequential immersion in successive cribs. Such a machine would require a very precise synchronization between the machine forward drive and the rotary drive of the tamping tool carrier to center the tamping tools properly in irregularly spaced cribs and to enable the tamping tools in the adjacent cribs to be suitably reciprocated for tamping the ballast under an interposed tie. Also, a relatively massive carrier is required for the numerous tamping tools mounted thereon. A machine of this type has not been built.

U.S. Pat. No. 3,795,198, dated Mar. 5, 1974, also discloses a continuously advancing track tamper. In this machine, the tamping head associated with each rail is longitudinally displaceable along a guide on the machine frame and a track lifting unit is mounted on the machine frame ahead of the tamping heads. While the machine frame with the track lifting unit advances continuously, the tamping heads must remain stationary during each tamping cycle and must then be rapidly driven forwardly along their guides until the tamping tools are centered over the next tie to be tamped. This machine may use standard tamping heads. The machine frame must be massive to enable it to sustain not only the loads of the tamping heads with their guides and drives but also the operating forces of the vibratory tamping tools and the track lifting unit. A machine of this type also has not been built.

A commercially very successful track wrking machine has been disclosed in U.S. Pat. No. 4,356,771, dated Nov. 2, 1982, wherein a self-propelled and intermittently incorporating leveling and lining reference systems is coordinated with a self-propelled control vehicle which advances non-stop. The control vehicle is coupled to the machine by a distance monitoring device and the machine operation may be effected from an operator's cab on the control vehicle and observed there by television. The operator effecting the remote control works more comfortably because he is not subject to the stop-and-go impacts of the machine nor is he subject to the vibrations of the working forces of the tamping, lifting and lining tools. However, the provision of the additional control vehicle, with the required remote control and television devices, makes this installation so expensive that it can be economically used only for special track work, such as laying of new track or rehabilitation of track for high-speed traffic, in which the uniformity of the tie positioning and of the ballast condition permits the operation to be highly automated. This enables the operator on the control vehicle to effectuate his control functions on the basis of the television picture received from the operating area of the machine and without requiring the assistance of the operator riding on the machine.

UK patent application No. 2,070,670, published Sept. 9, 1981, discloses a mobile ballast cleaning machine equipped with a track lifting device. A number of waste material carrying cars are coupled to the ballast cleaning machine and a track tamper with two additional track lifting devices is arranged between the ballast cleaning machine and the waste material carrying cars, a waste material conveying arrangement extending between the ballast cleaning machine and the waste material carrying cars and bridging over the tamper. The tamping heads associated with the respective track rails are longitudinally displaceably mounted on the tamper to enable them to advance intermittently while the train consisting of the ballast cleaning machine, the tamper and the waste material carrying cars moves non-stop. This work train makes it possible to lift the track by successively arranged lifting devices to a desired level in a single pass while cleaning the ballast. At the provisional level, the track is fixed by tamping the ballast under the ties and the successive lifting strokes are small enough to avoid undue flexing stresses on the track rails at any one lifting point. The track tamper frame remains subject to absorbing all operating forces and the operator on the tamper is subject to all the stresses of the operation.

U.S. Pat. No. 3,744,428, dated July 10, 1973, discloses a track leveling and tamping machine with a plurality of tamping units whose distance from each other may be changed, each tamping unit being mounted on a respective machine frame portion which are pivotally coupled together.

U.S. Pat. Nos. 4,534,295 and 4,496,193 both filed May 26, 1983, disclose a mobile track leveling, lining and tamping machine of the type inititally described hereinabove, and a model of such a non-stop advancing machine has been successfully built and operated, as reflected in an advertisement of the 09-CSM in "Der Eisenbahningenieur", No. 6, June 1983. This machine for the first time met the practical requirements and solved the problems encountered in the operation of such a machine. A substantial part of the weight and operating forces of the tamping, track lifting and lining means is transmitted to the track through the further undercarriage supporting the subframe means for stop-and-go movement while the heavy machine frame advances non-stop so that the latter is subjected to substantially smaller static and dynamic loads than in the machines proposed in the above-identified patents, wherein the individual tamping heads are longitudinally displaced on guides along the machine frame. At the same time, heavy impacts and vibrations are kept from the operator's cab on the machine frame so that the working conditions of the operator are considerably enhanced. This practical non-stop tamper has opened up a number of developmental possibilities and has initiated a new generation of track working machines.

It is the primary object of this invention to improve this new non-stop track leveling, lining and tamping machine personnel of the machine.

The above and other objects are accomplished according to the invention by arranging a stop-and-go advancement effecting means to operate on the further undercarriage supporting the subframe means, this stop-and-go advancement effecting means comprising a drive and/or brake means.

This simple auxiliary equipment eliminates or at least substantially reduces the substantial kinetic forces otherwise transmitted to the heavy machine frame by the accelerations and decelerations imparted to the subframe means by the repeated stop-and-go advancement from tamping cycle to tamping cycle. This, combined with the at least partial relief of the load and operating forces from the heavy machine frame due to the support of the subframe means on the track, results in enhanced working comfort for the operating personnel riding on the heavy machine frame. Furthermore, because of the reduced dynamic load on the heavy machine frame and its drive and/or brake means, they are subject to less wear and their operating safety is increased. In addition, the drive means arranged to operate on the further undercarriage supporting the subframe means on the track brings about a further shortening of the time required to advance the subframe means intermittently from tamping cycle to tamping cycle so that the entire operating cycle of the machine proceeds more rapidly to increase the efficiency of the machine. The machine also works more efficiently on rising and descending track sections because slippage of the subframe means at the beginning and the end of each advancement is avoided because of the application of its own drive and brake means. When the machine is moved from one working site to the next at relatively high speeds, the additional brake means operating on the subframe means will assist the brake means operating on the heavy machine frame. Altogether, the forward movement and braking will proceed much more smoothly so that the reference systems and indicating and control instruments moving on and with the heavy machine frame will be subject to fewer shocks, thus increasing the accuracy and uniformity of the operation.

Figure 2:
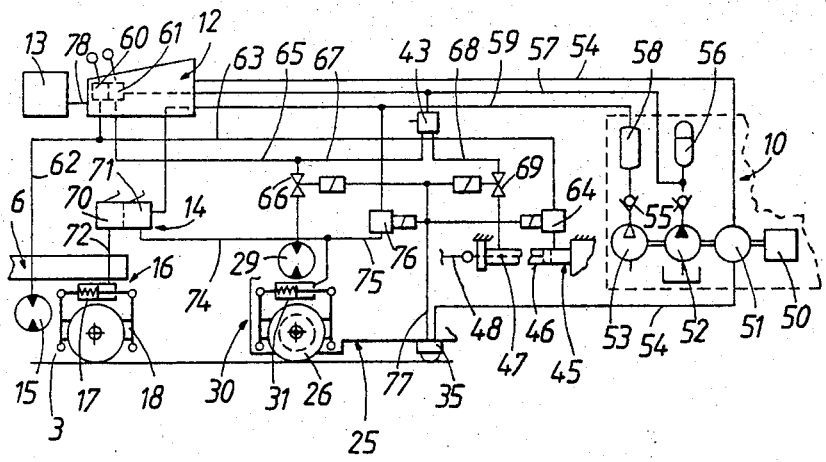
Figure 3:
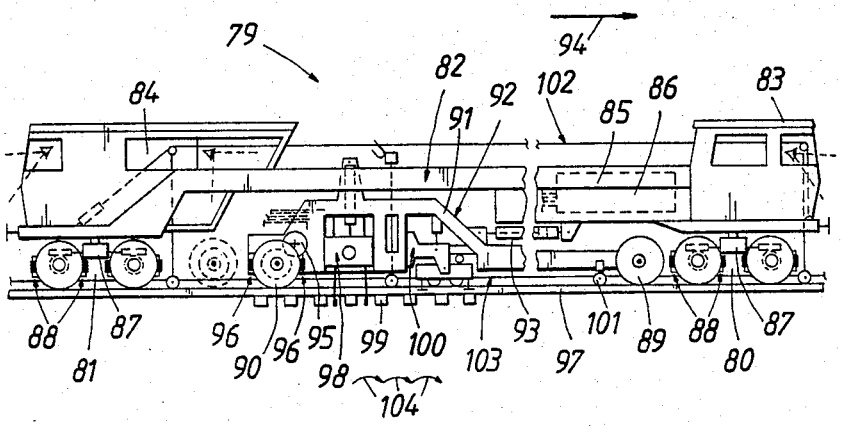
Figure 4:
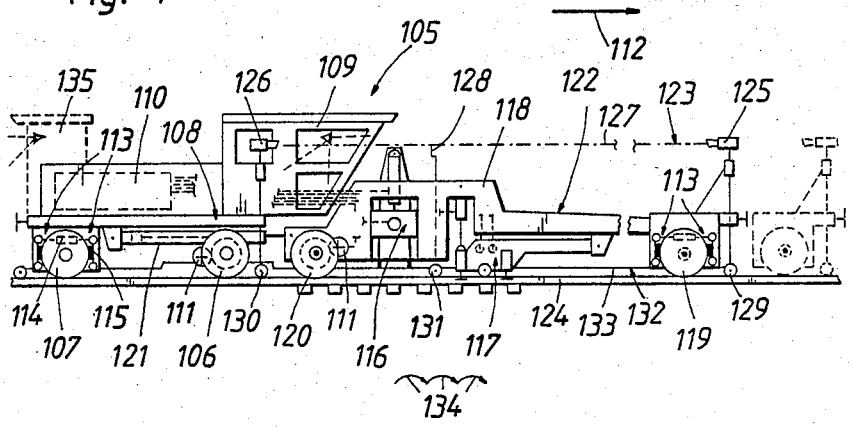

The above and other objects, advantages and features of the invention will become more apparent from the following detailed description of certain now preferred embodiments thereof, taken in conjunction with the accompanying, partially schematic drawing wherein FIG. 1 is a side elevational view of one embodiment of a non-stop advancing track leveling, lining and tamping machine;

FIG. 2 is a greatly simplified circuit diagram showing the control of the drive and brake means for the machine of FIG. 1; and FIGS. 3 and 4 are side elevational views of two further embodiments of a machine according to the present invention.

Referring now to the drawing and first to FIG. 1, there is shown mobile machine 1 for leveling, lining and tamping a track consisting of two rails 4 fastened to successive ties 5 resting on ballast. Machine 1 comprises heavy main frame 6 supported on undercarriages 2, 3 for continuous movement in an operating direction indicated by arrow 7. The two illustrated front and rear undercarriages are swivel trucks. Box-shaped part 9 on the heavy machine frame houses a power plant and operating control means 10 including motion effecting means consisting of drive means for continuously advancing the main frame along the track in the operating direction and brake means for stopping the advance of the main frame. In the illustrated embodiment, drive means 15 and brake means 16 are arranged to operate on rear swivel truck 3 for respectively advancing main machine frame 6 continuously in the operating direction and for stopping the main machine frame. As shown, an operator's cab 8 is mounted at the front end of heavy main frame 6 adjacent box-shaped part 9 and a further operator's cab 11 is mounted at the rear frame end and houses central drive and control panel 12 comprising control 13 and brake pedal 14. Brake means 16 controlled by the brake pedal is shown to comprise, per wheel, two brake shoes operated by pneumatic brake cylinder 17.

A lighter subframe means constituted in the illustrated embodiment by carrier frame 25 for the operating tools is pivotally and longitudinally adjustably connected to heavy main frame 6. Tamping means 34 are mounted on subframe means 25 for tamping ballast in intermittent tamping cycles under respective ties 5 at points of intersection of the two rails 4 and the respective ties. Track lifting and lining means 36 associated with the two rails are mounted on subframe means 25 ahead of tamping means 34 in the operating direction and are arranged on the subframe means between two undercarriages 2, 26 spaced in the direction of the track, undercarriage 26 supporting subframe means 25 on the track. Heavy machine frame 6 is an elongated frame and the two undercarriages 2, 3 are spaced apart a considerable distance, further undercarriage 26 supporting subframe means 25 being arranged between undercarriages 2, 3 supporting heavy main frame 6. In this arrangement, most of the weight of the tamping and track lifting and lining means rests on the rear supporting undercarriage of the subframe means so that the drive and/or brake forces will be most effectively transmitted to the track, thus providing very favorable drive and brake conditions.

Machine 1 also comprises track leveling reference system 19 and track lining reference system 23 associated with track lifting and lining means 36. The leveling reference system comprises a respective reference wire 20 above each rail 4, the front ends of the reference wires being supported on track sensing element 21 in the uncorrected track section while their rear ends are supported on track sensing element 22 in the corrected track section. The only partially shown lining reference system comprises tensioned reference wire 24 extending centrally between the two rails.

The illustrated subframe has a forwardly projecting beam-shaped end 27 longitudinally adjustably and pivotally guided in roller guide 28, as more fully, disclosed in copending Pat. Nos. 4,534,295 and 4,596,193 whose disclosures are incorporated herein by way of reference. Undercarriage 26 supports and guides the subframe means at the rear end thereof and tamping means 34 and track lifting and lining means 36 are arranged adjacent the rear end. With this weight distribution, excellent drive and brake conditions are obtained even if there is slippage between the wheels of undercarriage 26 and the track, such as wetness or the presence of leaves on the track rails.

Drive 45 for stop-and-go advancement of the subframe synchronously with the intermittent tamping cycles corresponding to the spacing between the ties to be tamped is shown to comprise hydraulic cylinder-and-piston device 46 affixed to heavy main frame 6, piston rod 47 of the drive being universally linked by connecting rod 48 to subframe 25. The stop-and-go advancement of the subframe means is symbolically indicated by arrows 49.

According to this invention, stop-and-go advancement effecting means are arranged to operate on further undercarriage 26 and, in the illustrated embodiment, this comprises drive means 29 and brake means 30. The illustrated brake means comprises brake shoes 32 operated by pneumatic brake cylinder 31. Since operator's cab 11 is mounted on main machine frame 6 within range of further undercarriage 26 and the operating control means comprises control 13 in the cab for actuating the tamping means, the track lifting and lining means, and the stop-and-go advancement drive means, the tamping means and the track lifting and lining means being within visual sight of the operator's cab, the operator in the cab has the ability carefully to monitor the operation and to operate the controls manually in case of need.

It will be useful to utilize standard drives and brakes to operate on undercarriage 26 and, preferably, to utilize the same drive and brake to operate on the undercarriage supporting the main frame. This not only rationalizes the production and simplifies the storage of spare prts but also makes the control of the brakes and drives easier, making it possible, for examle, to operate the drives of the main frame and subframe in parallel from a single control when the machine is driven uphill.

Tamping means 34 comprises a respective tamping head associated with each rail 4 and vertically movably mounted on 35 is mounted below the tamping means to measure the distance traveled by the carrier frame. Track lifting and lining means 36 comprises a track engaging unit with pivotal lifting rollers 39 and flanged lining rollers 40 engaging the track rails and this unit is linked to carrier frame 25 by lifting drives 37 and lining drives 38. Track sensing element 41 runs on the track between tamping means 34 and track lifting and lining means 36 and has a track level sensor 42, such as a rotary potentiometer, associated with each rail for cooperation with respective leveling reference wire 20. To enable the track to be lifted and/or lined sufficiently without undue stress on the rails, the distance between front swivel truck 2 and undercarriage 26 is at least about 8 m.

As conventional, each tamping head comprises a tamping tool carrier and vertical adjustment drive 33 lowers the tamping tool carrier at the beginning of each tamping cycle and raises it at the end of each tamping cycle. Means for sensing the lowering and raising of the tamping tool carrier head.

The simplified control circuit diagram of FIG. 2 is limited to the circuit connecting drive and brake means 16, 30, 15, 29 of the motion-effecting means for the main frame and the stop-and-go advancement effecting means for the subframe as well as drive 45 for the stop-and-go advancement of the subframe to power plant and operating control means 10 actuated by control 13 at control panel 12 in operator's cab 11. Power plant and operating control means 10 comprise drive motor 50, for example a multi-cylinder diesel motor, generator 51 for generating the electric power supply for operation of the machine, hydraulic pump 52 delivering hydraulic fluid from a sump to the hydraulic fluid-operated drives and compressor 53 for compressing air for delivery to the pneumatic drives coupled to the motor. Electric power supply lines 54 lead from generator 51 to control panel 12 and odometer 35, respectively. Hydraulic fluid supply conduit 57 connects hydraulic fluid storage tank 56 and hydraulic fluid pump 52 to the control panel, check valve 55 being arranged between the pump and the storage tank. Compressed air supply conduit 59 connects compressed air storage tank 58 and compressor 53 to the control panel, check valve 55 being arranged between the compressor and the storage tank. Two independent control levers 60, 61 on control panel 12 are associated with hydraulic fluid supply conduit 57. Control conduit 62 connects an output controlled by control lever 60 with drive 15 for main frame 6, which is a hydraulic motor, and control conduit 63 connects this output through solenoid valve 64 with one of the chambers of the cylinder of drive 45. Control conduit 65 connects an output controlled by control lever 61 through solenoid throttle valve 66 to drive 29 operating on undercarriage 26 supporting subframe 25, drive 29 also being a hydraulic motor. Independently of this connection, drive 29 is also connected with hydraulic fluid supply conduit 57 through limit switch 43, which is a mechanically operated valve, by hydraulic fluid branch conduit 67. Another hydraulic fluid supply conduit 68 leads from limit switch 43 to the other chamber of the cylinder of drive 45 through solenoid throttle valve 69.

Brake pedal means 14 at control panel 12 comprises two independently operable pedals 70 and 71 constituted by valves in compressed air conduit 59 connecting the pedals to compressed air storage tank 58. Compressed air conduit 72 connects pedal 70 to brake cylinder 17 for the brake means operating on undercarriage 3 and compressed air conduit 74 connects pedal 71 to brake cylinder 31 for the brake means operating on undercarriage 26. Independently of this connection, conduit 75 connects brake cylinder 31 through solenoid valve 76 to compressed air supply conduit 59. The windings of throttle valves 66 and 69 as well as valves 64 and 76 may be energized through line 77 connecting the windings to odometer 35. For the automatic control of the drive and brake functions, the controls on panel 12 are connected by lines 78 with central control 13.

The operation of the above-described machine proceeds as follows:

At the beginning of the operation, carrier frame 25 is brought into its foward position shown in full lines in FIG. 1. In this position, the tamping tools of tamping means 34 are centered over a tie to be tamped. With control lever 61 in stop position, no hydraulic fluid is supplied to drive 29 while brake pedal 71 is operated to supply compressed air to brake cylinder 31 to stop the carrier frame while the tamping heads are lowered to immerse the tamping tools in the ballast where they are vibrated and reciprocated to tamp ballast under the tie in the usual tamping cycle. At the same time, pedal 70 is operated to release brake means 16 and control lever 60 is operated to actuate drive 15 so that main machine frame 6 advances continuously at the desired speed. This also causes hydraulic fluid to flow through conduit 63 and valve 64 to one of the chambers of the cylinder of drive 45 to move piston rod 47 continuously rearwards in the opposite direction to the forward movement of the main frame. Therefore, subframe 25 remains in a stationary position while main frame 6 continuously advances. After the tamping cycle has been completed, brake pedal 71 is operated to release brake means 30 and the tamping heads are raised to cause their abutments 44 to trip limit switch 43. This causes hydraulic fluid to flow from supply conduit 57 through conduit 67 and opened throttle valve 66 to drive 29 and, simultaneously, through conduit 68 and opened throttle valve 69 to the other chamber of the cylinder of drive 45. Therefore, the combined force of drives 29 and 45 causes subframe 25 to advance rapidly from its rear position shown by undercarriage 26 in broken lines to the forward position. At the start of this rapid advance of the subframe, odometer 35 is energized and this generates a control signal after the subframe proceeds a distance corresponding to the average distance between two successive ties less a pre-calculated braking distance. This control signal is transmitted by line 77 to the windings of solenoid valves 64, 66, 69 and 76 to operate the valves so that drive 29 is stopped and brake means 30 is actuated. Valves 64 and 69 are pre-adjusted to provide a delay in cutting off the supply of hydraulic fluid to one of the cylinder chambers and supplying hydraulic fluid to the other cylinder chamber of drive 45 so that the subframe is stopped in a position wherein the tamping tools are centered over the next tie. Thus, braking and driving of subframe 25 by the stop-and-go advancement influencing means operating on undercarriage 26 of the subframe is synchronized with the tamping cycles since it is controlled by limit switch 43 tripped by the lowering and raising of the tamping heads and odometer 35 which measures the distance of each intermittent advancement of the subframe. The operator at control panel 12 and central control 13 has the entire operation in clear view and is, therefore, in a perfect position to control the drives and operations of the tamping means as well as the track lifting and lining means.

As will be apparent from FIG. 1, brake 16 for stopping the continuous advance of main frame 6 and brake 30 for stopping the advancement of subframe 25 are respectively arranged to operate on rear undercarriage 3 of the main frame and rear undercarriage 26 of the subframe, which undercarriages are arranged immediately adjacent each other, and power plant 10 comprises common source 58 of pressure fluid for both brakes. Drive 15 for the continuous advance of the main frame and drive 29 for the subframe also have a common connection to the power plant. This arrangement shortens the pressure fluid supply conduits to the brakes and drives and makes them easier to install and maintain. Furthermore, braking and driving can be controlled from control panel 12. The operating control means comprises means for intermittently actuating the stop-and-go advancement effective means, i.e. the brake and drive operating on undercarriage 26, in response to the tamping cycles by sensing the lowering and raising of the tamping tool carriers. The sensing means includes limit switch means 43 connected to the operating control means, preferably through time-delay means. Such a control may be constructed from readily available control and switching components of known dependability to obtain a smooth and rapid operating sequence of tamping and advancement of the tamping means to the next tamping cycle. The efficiency of the machine is thus further enhanced while maintaining a high quality of track correction and tamping. With odometer means 35 measuring the intermittent advancement of subframe means 25 and generating a control signal corresponding to each measured advancement and actuating the stop-and-go advancement effecting means, i.e. brake and drive of the subframe, in response to the control signal, the automatic centering of the tamping tools over each tie is assured. This relieves the operating personnel from this repetitive control task which requires high concentration, thus further increasing the work comfort and also assuring a highly accurate, yet rapid, stop-and-go movement of the subframe. Drive 45 comprises a hydraulic cylinder-and-piston device and the operating control means is arranged for common control of the device and the stop-and-go advancement effecting means, i.e. drive 29 and brake 30. This additionally shortens the time for advancing the subframe from tamping cycle to tamping cycle because it provides higher acceleration as well as a shortening of the brake path for the subframe.

When machine 1 is moved from working site to working site, either in the direction of arrow 7 and in the opposite direction, drive control levers 60, 61 and brake pedals 70, 71 are coupled so that drives 15, 29 as well as brakes 16, 30 for the main frame and the subframe are operated together with one drive control lever and one brake pedal. Cylinder-and-piston drive 46 is blocked to hold subframe 25 in the rear position with respect to main frame 6 while the machine continuously advances at relatively high speed to the next working site.

Similarly to the embodiment of FIG. 1, non-stop advancing truck leveling, lining and tamping machine 79 of FIG. 3 also has a heavy main frame 82 whose front and rear ends are respectively supported by undercarriages 80 and 81 for non-stop movement in an operating direction indicated by arrow 94. The main machine frame carries front operator's cab 83 and rear operator's cab 84, power plant and operating control means 85 being arranged on front portion 86 of the main frame. In this embodiment, the motion-effecting means for the main frame comprises drives 87 and brakes 88 arranged to operate on both undercarriages 80 and 81, and subframe means 92 is a carrier frame 91 supported on the track on two undercarriages 89, 90 between swivel trucks 80, 81, tamping means 98 for tamping ballast under ties 99 and track lifting and lining means 100 being arranged between undercarriages 89, 90. Since subframe means 92 is a satellite vehicle fully supported on the track, main frame 82 carrying the operator's cabs is completely relieved of the load and working forces of the track correction tools, in addition to being free of the impacts due to the repeated acceleration and deceleration of the subframe means. This provides maximum working comfort while maintaining the high efficiency and accuracy of track leveling, lining and tamping.

Cylinder-and-piston drive 93 longitudinally adjustably and pivotally connects carrier frame 91 to main frame 82 and drive 95 and brake 96 are arranged to operate on rear undercarriage 90 of the carrier frame. Odometer 101 is arranged on carrier frame 91 immediately behind front undercarriage 89 and, as in the embodiment of FIG. 1, the machine is equipped with leveling and lining reference systems 102 and 103. Arrows 104 symbolize the intermittent advance of carrier frame 91 in relation to the continuous advance of main frame 82.

The operation of machine 79 will be obvious from the above description of the control of machine 1. As has been explained, the acceleration and deceleration impacts of the subframe from tamping cycle to tamping cycle will be completely removed from the main frame because of drive 95 and brake 96 operating on the rear undercarriage of the subframe. Wear on the operating personnel as well as the structural components of the machine is reduced to a minimum. As in FIG. 1, operator's cab 84 is arranged immediately behind or above rear undercariage 90 of the subframe to keep the operation within sight of the operator in this cab.

Machine 105 shown in FIG. 4 comprises heavy main machine frame 108 supported on rear undercarriage 107 and front undercarriage 106, and having a front end overhanging front undercarriage 106. Operator's cab 109 is mounted on the overhanging front end of the heavy machine frame which also carries power plant and operating control means 110. Drive 111 operates on front undercarriage 106 for continuously advancing heavy main frame 108 in an operating direction indicated by arrow 112. Brake 113 including brake cylinder 114 actuating brake shoes 115 operates on rear undercarriage in the operating direction, undercarriage 120 supporting and guiding the subframe means at the rear end thereof while undercarriage 119 supports and guides the front end of the subframe means on the track. Tamping means 116 and track lifting and lining means 117 are arranged on the subframe means adjacent the rear end thereof and the subframe means precedes front undercarriage 106 in the operating direction. The tamping means and the track lifting and lining means are within visual sight of the operator in cab 109. Cylinder-and piston drive 121 longitudinally adjustably and pivotally connects subframe means 118 to the main frame. Drive 111 is arranged to operate on rear undercarriage 120 of the subframe and brake 113 is arranged to operate on its front undercarriage 119. The drives and brakes for the main frame and the subframe are of the same type.

Track leveling, lining and tamping machine 105 is equipped with optical leveling system 123 comprising, for each rail 124, light beam emitter 125, light beam receiver 126 aligned therewith and shadowboard 128 in the path of reference light beam 127. The two light beam emitters are mounted on track level sensing element 129 running on the uncorrected track section while the two light beam receivers are guided along the track on track level sensing element 130 in the range of cab 109 in the corrected track section. Further track leveling sensing element 131 carries shadowboards 128 between tamping means 116 and track lifting and lining means 117. Lining reference system 132 comprises lining reference rod 133 mounted on the subframe for movement therewith and serves as a reference for measuring the ordinate of the track in the range of the track lining means. The stop-and-go advancement of the subframe means is symbolized by arrows 134. The operation of the machine proceeds in a manner equivalent to that described hereinabove in connection with FIGS. 1 to 3. The forward position of subframe 122 has been indicated in broken lines in FIG. 4. Another operator's cab 135 is mounted at the rear end of the heavy main machine frame and the operating control means comprises a control for drive 111 and brake 114 for the main frame at cab 135.

This embodiment has all the advantages described hereinabove in connection with the embodiments of FIGS. 1 and 3 but provides an even more advantageous weight distribution between main frame and subframe, thus enhancing the accuracy of the track correction and the smoothness of the drive. Operator's cab 109 enables the operator therein to be in full control of all track maintenance work effected by the machine while cab 135 is used when the machine is moved to another working site in a direction opposite to the operating direction indicated by arrow 112.

While the present invention has been described and illustrated in connection with certain now preferred embodiments, it will be obvious to those skilled in the art that various modifications may be effected without departing from the spirit and scope of this invention as defined in the appended claims. For instance, the drives and/or brakes may be arranged to operate on both undercarriages of the subframe, particularly where the tamping means comprises heavy tamping heads with twin tamping tool arrangements for tamping two successive ties simultaneously. On the other hand, in lighter machine types, the stop-and-go advancement effecting means arranged to operate on the undercarriage supporting the subframe may consist only of a drive or a brake. In any case, this auxhli'ry equipment considerably damps the impact forces on the main frame due to the stop-and-go advancement of the subframe, thus increasing the comfort of the work environment while reducing the time required for the intermittent forward drive of the subframe.

What is claimed is:

1. A mobile machine for leveling, lining and tamping a track consisting of two rails fastened to successive ties resting on ballast, which comprises (a) a heavy main frame supported on undercarriages for continuous movement in an operating direction, (b) a power plant and operating control means including a first motion-effecting means consisting of drive means for continuously advancing the main frame along the track in the operating direction and brake means for stopping the advance of the main frame, the power plant and the control means being carried by the min frame and at least one of the motion-effecting means being arranged to operate on at least one of the undercarriages, (c) a lighter subframe means pivotally and longitudinally adjustably connected to the heavy main frame, (1) the subframe means having a rear end, in the operating direction, (d) tamping means mounted on the subframe means for tamping ballast in intermittent tamping cycles under respective ones of the ties at pointe of intersection of the two rails and the respective ties, (e) track lifting and lining means associated with the two rails mounted on the subframe means ahead of the tamping means in the operating direction and being arranged on the subframe means between two undercarriages spaced in the direction of the track, at least one of said undercarriages wherebetween the tamping and track lifting and lining means are arranged being a further undercarriage supporting the subframe means on the track at the rear end thereof, the tamping means and track lifting and lining means being arranged adjacent the rear end, (f) an operator's cab mounted on the main machine frame within the range of the further undercarriage and the tamping means and the track lifting and lining means being within visual sight of the operator's cab, (g) track leveling and lining reference systems associated with the track lifting and lining means, and (h) a stop-and-go advancement effecting means for the subframe means tamping cycles, and arranged to operate on the further undercarriage, the stop-and-go advancement effecting means comprising at least one further motion-effecting means consisting of a drive means and a brake means.

2. The track leveling, lining and tamping machine of claim 1, wherein the further motion effecting means comprises a drive means.

3. The track leveling, lining and tamping machine of claim 1, wherein the further motion effecting means comprises a brake means.

4. The track leveling, lining and tamping machine of claim 1, wherein the further motion effecting means comprises a drive means and a brake means.

5. The track leveling, lining and tamping machine of claim 1, further comprising means for longitudinally and pivotally connecting a front end of the subframe means to the main frame.

6. The track leveling, lining and tamping machine of claim 1, wherein the operating control means comprises controls in the cab for actuating the tamping means, the track lifting and lining means, and the stop-and-go advancement effecting means.

7. The track leveling, lining and tamping machine of claim 1, wherein the heavy machine frame is an elongated frame supported on two of said undercarriages spaced apart a considerable distance, the further undercarriage supporting the subframe means being arranged between the two undercarriages supporting the heavy machine frame.

8. The track leveling, lining and tamping machine of claim 1, wherein the subframe means is a subframe supported on the track on two of said further undercarriages wherebetween the tamping and track lifting and lining means are arranged, one of the further undercarriages being a rear undercarriage, in the operating direction.

9. The track leveling, lining and tamping machine of claim 1, wherein the brake means for stopping the continuous advance of the main frame comprises a brake arranged to operate on one of the undercarriages supporting the main frame, and the further motion effecting means comprises another brake means arranged on the further undercarriage supporting the subframe means, the undercarriages on which the brake means are arranged being immediately adjacent each other, and the power plant comprises a common source of pressure fluid for both brakes.

10. The track leveling, lining and tamping machine of claim 1, wherein the first motion-effecting means comprises a drive for continuously advancing the main frame along the track in the operating direction and a brake for stopping the advance of the main frame, the drive and brake being arranged to operate on one of the undercarriages supporting the main frame, the further motion effecting means comprises a drive for the subframe means arranged to operate on the further undercarriage supporting the subframe means, the undercarriage supporting the main frame being arranged immediately behind the further undercarriage supporting the subframe means, in the operating direction, and the two drives have a common connection to the power plant.

11. The track leveling, lining and tamping machine of claim 1, wherein the operating control means comprises means for intermittently actuating the further motion effecting means in response to the tamping cycles.

12. The track leveling, lining and tamping machine of claim 11, wherein the tamping means comprises a tamping tool carrier associated with each one of the rails, means for lowering the tamping tool carrier at the beginning of each tamping cycle and for raising the tamping tool carrier at the end of each tamping cycle, and means for sensing the lowering and raising of the tamping tool carrier, the sensing means including limit switch means and the limit switch means being connected to the operating control means.

13. The track leveling, lining and tamping machine of claim 1, further comprising an odometer means for measuring the intermittent advancement of the subframe means and generating a control signal corresponding to each measured advancement, wherein the operating control means is arranged to receive the control signal for intermittently actuating the further motion effecting means in response to the control signal.

14. The track leveling, lining and tamping machine of claim 1, wherein the drive means for continuously advancing the main frame comprises a hydraulic cylinder-and-piston device, and the operating control means is arranged for common control of the cylinder-and-piston device and the stop-and-go advancement effecting means.

15. The track leveling, lining and tamping machine of claim 1, wherein the subframe means has a rear end, in the operating direction, the further undercarriage supporting and guiding the subframe means at the rear end thereof, the tamping means and track lifting and lining means being arranged adjacent the rear end, one of the undercarriages supporting the heavy machine frame being a front undercarriage in the operating direction, the heavy machine frame having a front end overhanging the front undercarriage and the subframe means preceding the front undercarriage in the operating direction.

16. The track leveling, lining and tamping machine of claim 15, further comprising an operator's cab mounted on the overhanging front end of the heavy machine frame within visual sight of the tamping means and track lifting and lining means.

17. The track leveling, lining and tamping machine of claim 16, comprising another operator's cab mounted on a rear end of the heavy machine frame and wherein the operating control means comprises a control for the motion-effecting means at the other operator's cab.

* * * * *